US007367925B2

(12) United States Patent
Hsu

(10) Patent No.: US 7,367,925 B2
(45) Date of Patent: May 6, 2008

(54) ELLIPTICAL EXERCISE APPARATUS

(76) Inventor: Wen-Pin Hsu, No. 70, Ming Sheng Rd., Shen Kang, Taichung (TW)

( * ) Notice: Subject to any disclaimer, the term of this patent is extended or adjusted under 35 U.S.C. 154(b) by 93 days.

(21) Appl. No.: 11/511,914

(22) Filed: Aug. 28, 2006

(65) Prior Publication Data

US 2008/0051259 A1 Feb. 28, 2008

(51) Int. Cl.
*A63B 22/04* (2006.01)
*A63B 22/06* (2006.01)

(52) U.S. Cl. ..... 482/52; 482/57

(58) Field of Classification Search ..... 482/51–52, 482/57, 70, 79–80
See application file for complete search history.

(56) References Cited

U.S. PATENT DOCUMENTS 6,019,710 A * 2/2000 Dalebout et al. ..... 482/70
6,468,184 B1 * 10/2002 Lee ..... 482/52
6,629,909 B1 * 10/2003 Stearns et al. ..... 482/52
6,749,540 B1 * 6/2004 Pasero et al. ..... 482/52
7,041,034 B1 * 5/2006 Stearns et al. ..... 482/52
7,163,491 B2 * 1/2007 Rufino ..... 482/51
7,214,167 B2 * 5/2007 Stearns et al. ..... 482/52

* cited by examiner

*Primary Examiner*—Stephen R. Crow
(74) *Attorney, Agent, or Firm*—Townsend and Townsend and Crew, LLP

(57) ABSTRACT

An elliptical exercise apparatus includes two cranks disposed rotatably on a frame and rotatable about a common crank axis, two rails each disposed fixedly on the frame and having a non-circular guide slot, two extension links connected respectively, radially, and slidably to the cranks and mounted with rollers disposed respectively and movably within the guide slots, two connector members disposed on the frame and reciprocatable along a longitudinal direction of the frame, and two foot links each having a first end connected pivotally to the corresponding extension link and a second end connected pivotally to the corresponding connector member. When the rollers move along the rails, the extension links are extendable and retractable relative to the cranks, respectively.

6 Claims, 7 Drawing Sheets

ELLIPTICAL EXERCISE APPARATUS

BACKGROUND OF THE INVENTION

1. Field of the Invention

This invention relates to an exerciser, and more particularly to an elliptical exercise apparatus.

2. Description of the Related Art

Referring to FIG. 1, a first conventional elliptical exercise apparatus includes a frame 1, a pair of cranks 2 disposed pivotally on a rear end of the frame 1, a pair of front links 3 disposed on a front end of the frame 1, and a pair of foot links 4 mounted with pedals 401. Each of the foot links 4 is interconnected pivotally between the corresponding crank 2 and the corresponding front link 3.

Referring to FIG. 2, a second conventional elliptical exercise apparatus includes a frame 5, a pair of cranks 6 disposed pivotally on a front end portion of the frame 5, a pair of rollers 7 disposed movably on a rear end portion of the frame 5, and a foot link 8 mounted with a pedal 801. Each of the foot links 8 is interconnected pivotally between the corresponding crank 6 and the corresponding roller 7.

During exercise using the first and second conventional elliptical exercise apparatuses, each of the pedals 401, 801 moves along an elliptical path. Since the rotating radius of each of the cranks 3, 6 is fixed, the major and minor axes of the elliptical paths traveled by the pedals 401, 801 are short, thereby resulting in a poor exercising effect. To obtain a better exercising effect, the cranks 2, 6 may be lengthened. However, this increases the volumes of the exercise apparatuses.

SUMMARY OF THE INVENTION

Therefore, the object of this invention is to provide an elliptical exercise apparatus that can lengthen the major and minor axes of an elliptical path traveled by a pedal without an increase in the volume of the elliptical exercise apparatus.

According to this invention, an elliptical exercise apparatus comprises:

an elongated frame having opposite first and second ends;

a pair of left and right cranks each mounted rotatably on the frame and rotatable about a common crank axis;

a pair of left and right rails each disposed fixedly on the first end of the frame and having an inner rail surface disposed around the common crank axis, an outer rail surface disposed around the inner rail surface, and a non-circular guide slot defined between the inner and outer rail surfaces;

a pair of left and right extension links each having a first connecting portion, a second connecting portion, and a third connecting portion, the first connecting portions of the left and right extension links being connected respectively, radially, and slidably to the left and right cranks, the second connecting portion of each of the left and right extension links being mounted with a rotatable roller, the rollers being disposed respectively and movably within the guide slots;

a pair of left and right connector members disposed on the second end of the frame and reciprocatable along a longitudinal direction of the frame; and a pair of left and right foot links each having first and second ends connected respectively and pivotally to the third connecting portion of a corresponding one of the left and right extension links and a corresponding one of the left and right connector members.

During exercise, the left and right extension links are extendable and retractable relative to the left and right cranks, respectively. Thus, the major and minor axes of the elliptical paths traveled by pedals on the foot links are long, thereby resulting in a good exercising effect.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
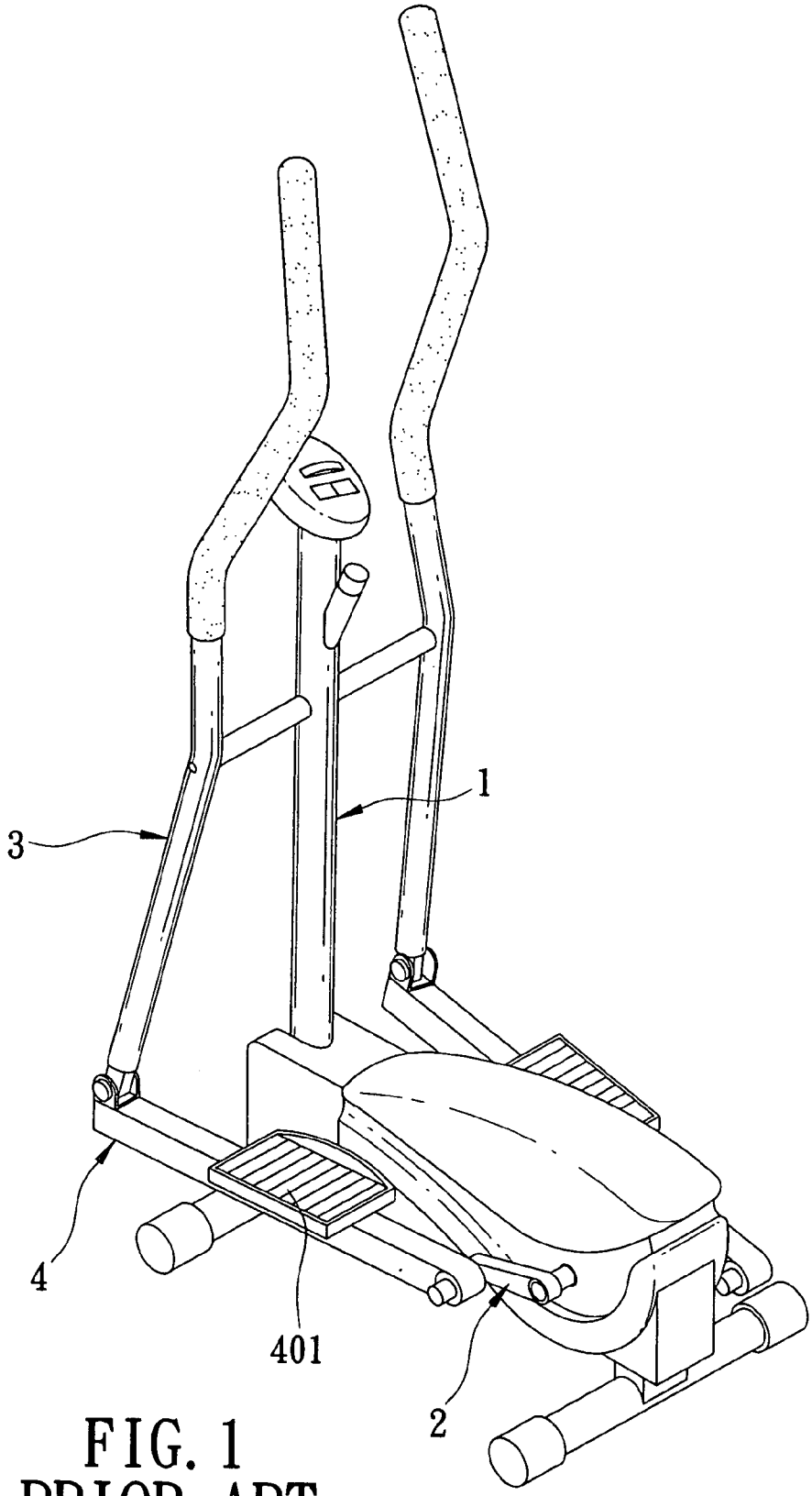
FIG. 1 PRIOR ART
FIG. 1 is a perspective view of a first conventional elliptical exercise apparatus.
Figure 2:
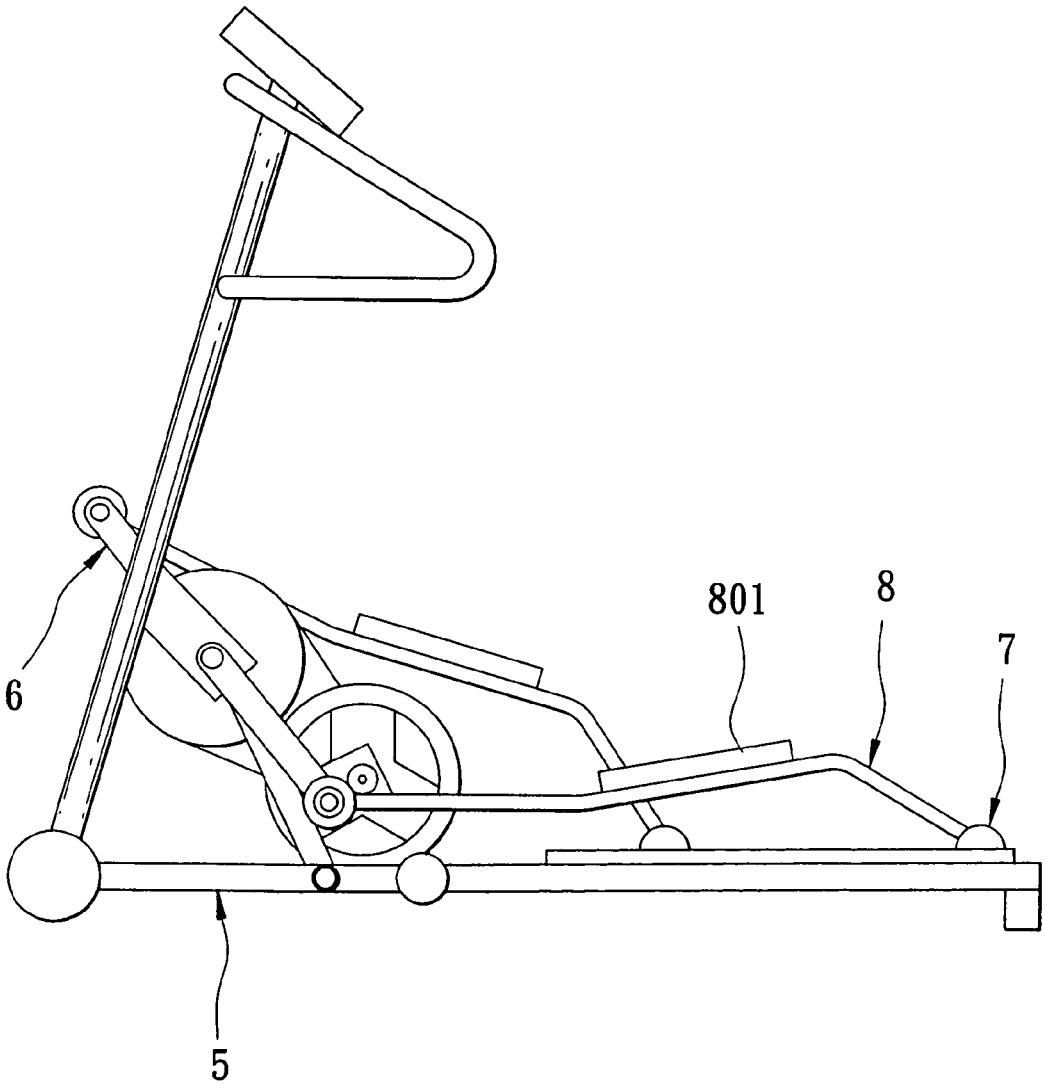
FIG. 2 PRIOR ART
FIG. 2 is a side view of a second conventional elliptical exercise apparatus.
Figure 3:
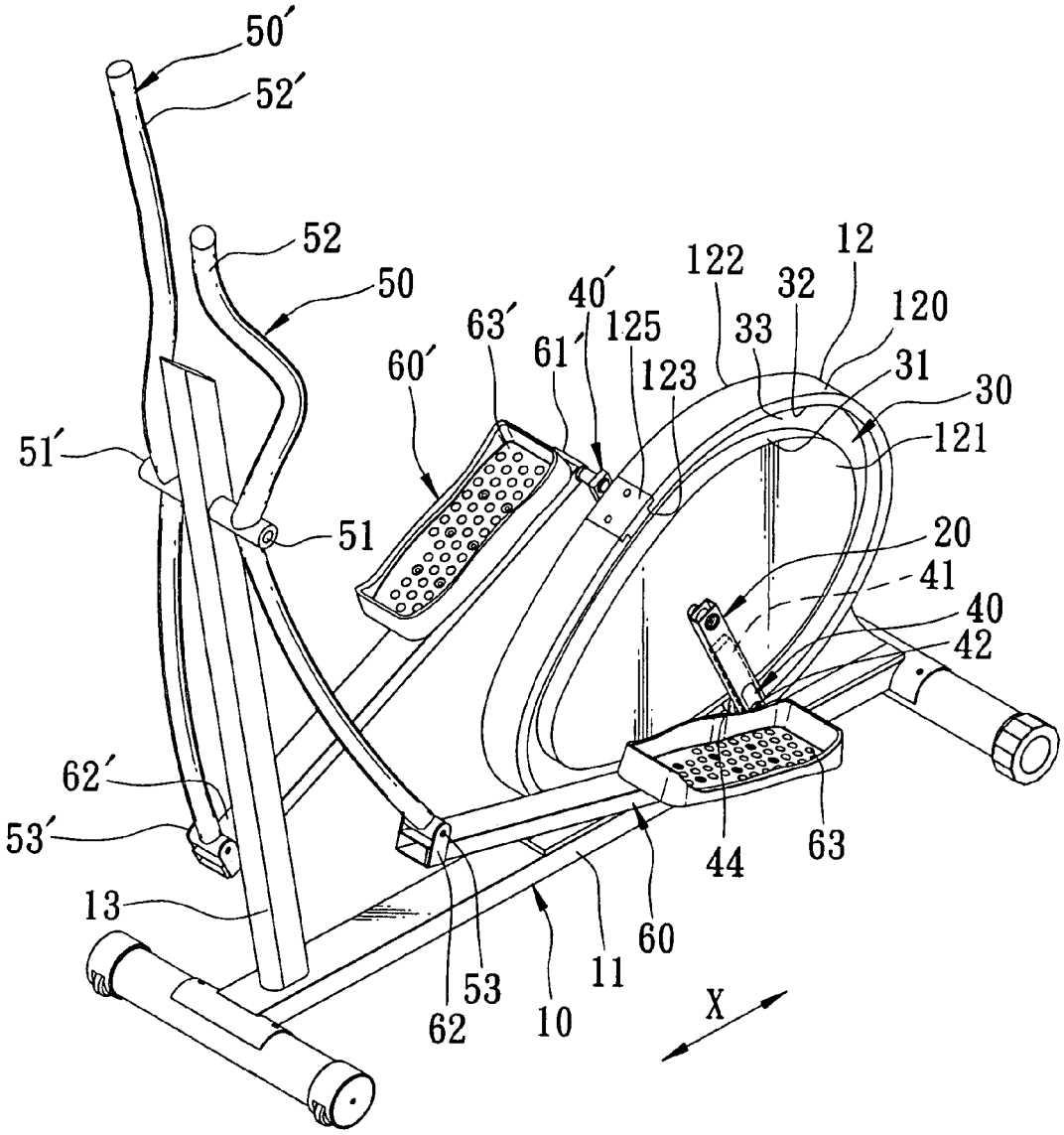
FIG. 3 is a perspective view of the preferred embodiment of an elliptical exercise apparatus according to this invention.
Figure 4:
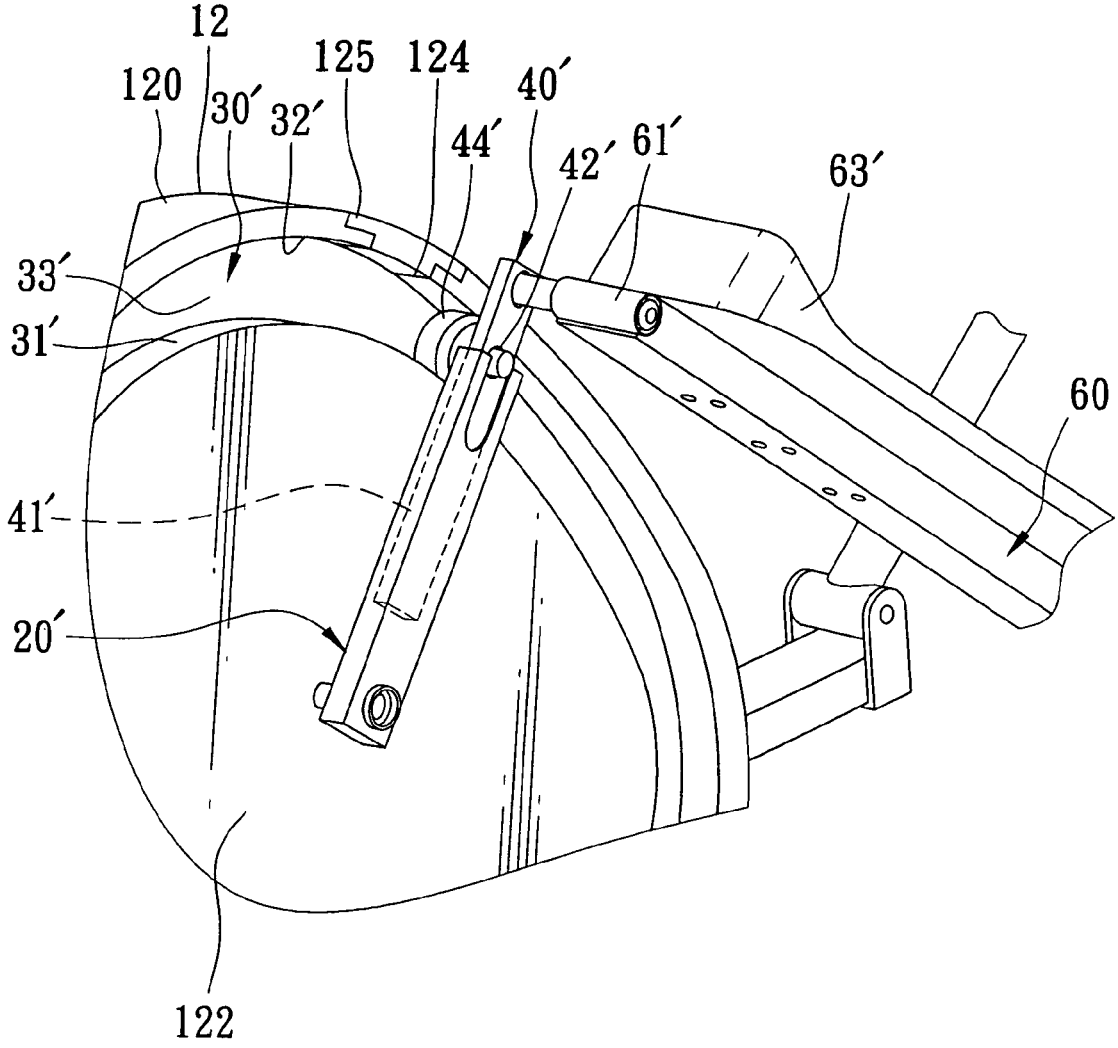
FIG. 4 is a fragmentary perspective view of the preferred embodiment, illustrating a connection between a right crank and a right extension link.
Figure 5:
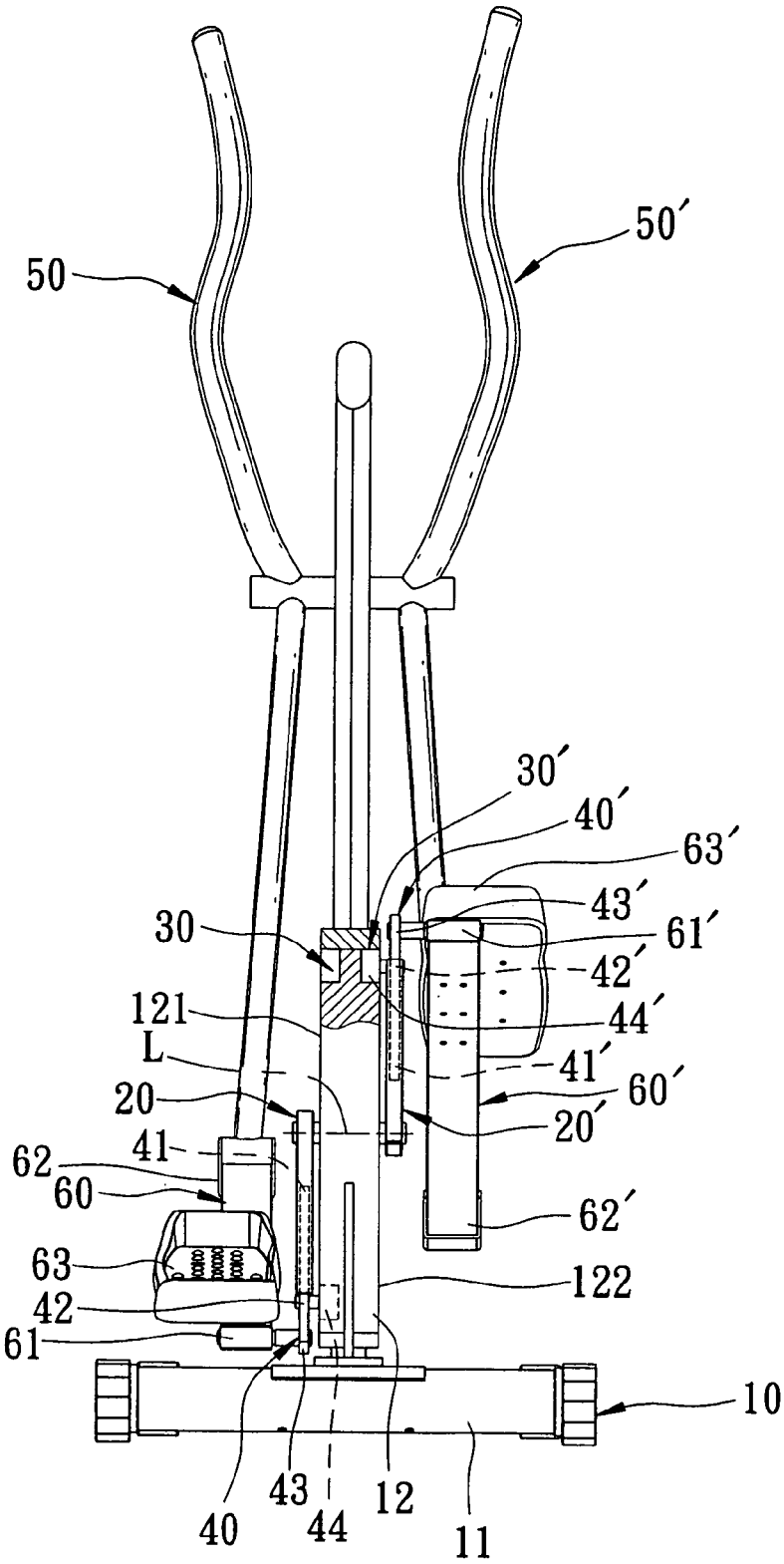
FIG. 5 is a partly sectional rear view of the preferred embodiment, illustrating two guide slots.

Referring to FIGS. 3, 4, and 5, the preferred embodiment of an elliptical exercise apparatus according to this invention includes an elongated frame 10, a pair of left and right cranks 20, 20', a pair of left and right rails 30, 30', a pair of left and right extension links 40, 40', a pair of left and right connector members 50, 50', and a pair of left and right foot links 60, 60'. The frame 10 includes an I-shaped bottom frame 11, a vertical mounting plate 12 fixed on a first end portion (i.e., rear end portion) of the bottom frame 11, and an upright rod 13 fixed on a second end portion (i.e., front end portion) of the bottom frame 11.

The left and right cranks 20, 20' are configured as rectangular tubes, are mounted respectively and rotatably on left and right side surfaces 121, 122 of the mounting plate 12, and are rotatable about a common crank axis (L) (see FIG. 5).

The left and right rails 30, 30' are formed respectively in the left and right side surfaces 121, 122 of the mounting plate 12, and are disposed in proximity to a periphery of the mounting plate 12. Each of the left and right rails 30, 30' has an inner rail surface 31, 31' disposed around the common crank axis (L), an outer rail surface 32, 32' disposed around the inner rail surface 31, 31', and a non-circular guide slot 33, 33' defined between the inner rail surface 31, 31' and the outer rail surface 32, 32'. In this embodiment, the guide slots 33, 33' are oval. With additional reference to FIG. 6, each of the guide slots 33, 33' has a major axis (I) and a minor axis (II) that is perpendicular to and extends through a middle point of the major axis (I).

Each of the left and right extension links 40, 40' is configured as a rod having a rectangular cross section, and has a first connecting portion 41, 41', a second connecting portion 42, 42', and a third connecting portion 43, 43'. The first connecting portions 41, 41' are connected respectively, radially, and slidably to the left and right cranks 20, 20'. For each of the left and right extension links 40, 40', the second connecting portion 42, 42' is located between the first connecting portion 41, 41' and the third connecting portion 43, 43', and is mounted with a rotatable roller 44, 44'. The rollers 44, 44' are disposed respectively and movably within the guide slots 33, 33', and can roll on the inner rail surfaces 31, 31' and the outer rail surfaces 32, 32'.

The left and right connector members 50, 50' are disposed respectively on two opposite sides of the upright rod 13. Each of the left and right connector members 50, 50' has an upper pivot point 51, 51' disposed pivotally on the upright rod 13, a handle section 52, 52' disposed above the upper pivot point 51, 51', and a lower pivot point 53, 53' opposite to the handle section 52, 52' and disposed below the upper pivot point 51, 51'. As such, the lower pivot points 53, 53' are pivotable reciprocally relative to the frame 10 along a longitudinal direction of the frame 10.

Each of the left and right foot links 60, 60' has a first end 61, 61' connected pivotally to the corresponding third connecting portion 43, 43', a second end 62, 62' connected pivotally to the corresponding lower pivot point 53, 53', and a pedal 63, 63' fixed thereon and disposed in proximity to the first end 61, 61'.

The mounting plate 12 includes a plate body 120 formed with an adjacent pair of openings 123, 124, and a seal plate 125 connected removably to the plate body 120. The plate body 120 has an annular outer surface defining the periphery of the mounting plate 12 and formed with the openings 123, 124. The openings 123, 124 are communicated respectively with the guide slots 33, 33', and are sealed by the seal plate 125. The openings 123, 124 are sized so as to allow the rollers 44, 44' to be passed respectively therethrough when the seal plate 125 is removed from the plate body 120. Hence, during assembly, the rollers 44, 44' can be moved into the guide slots 33, 33' through the openings 44, 44'.

Figure 6:
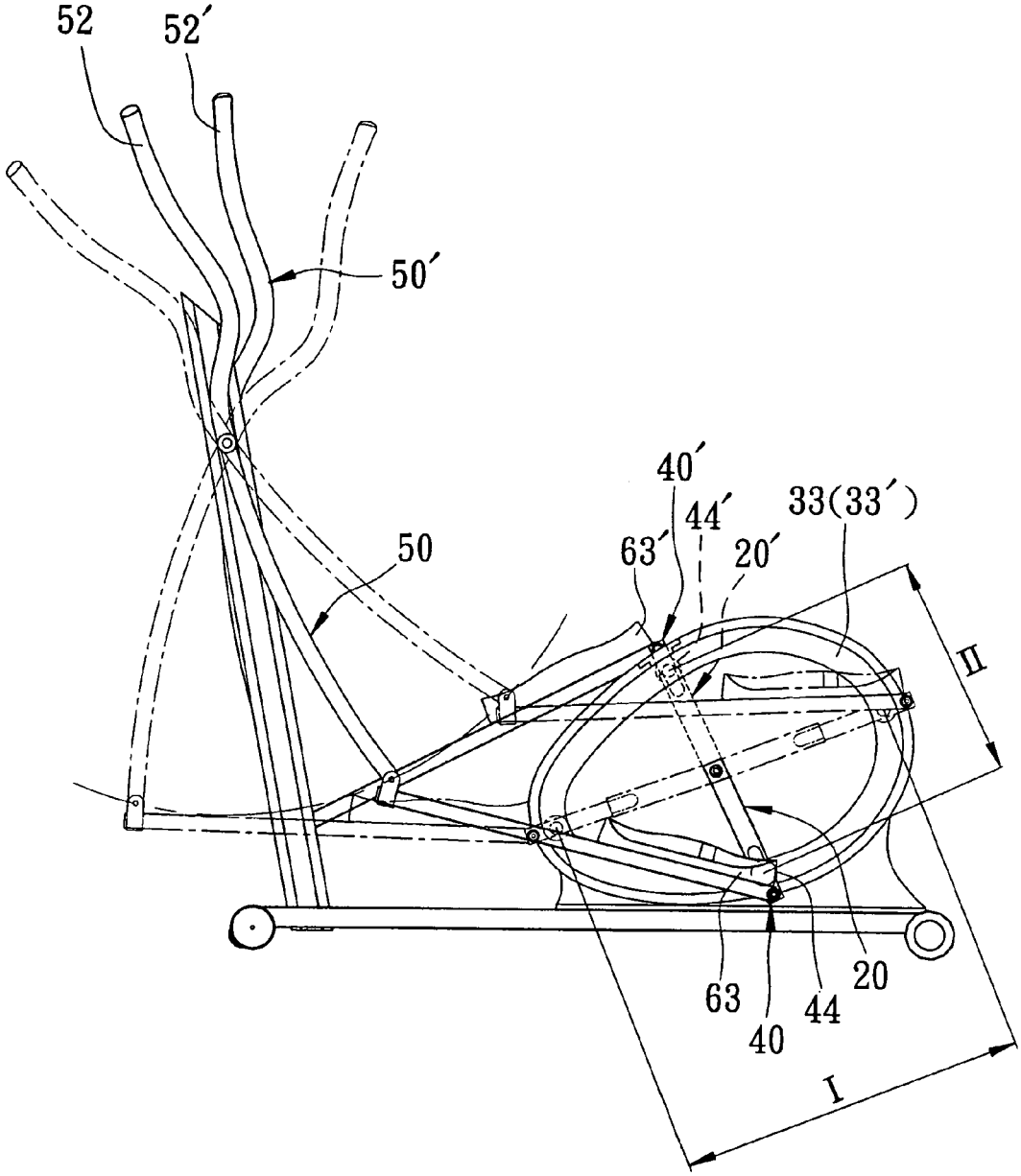
FIG. 6 is a schematic side view of the preferred embodiment, illustrating operation of the elliptical exercise apparatus.
Figure 7:
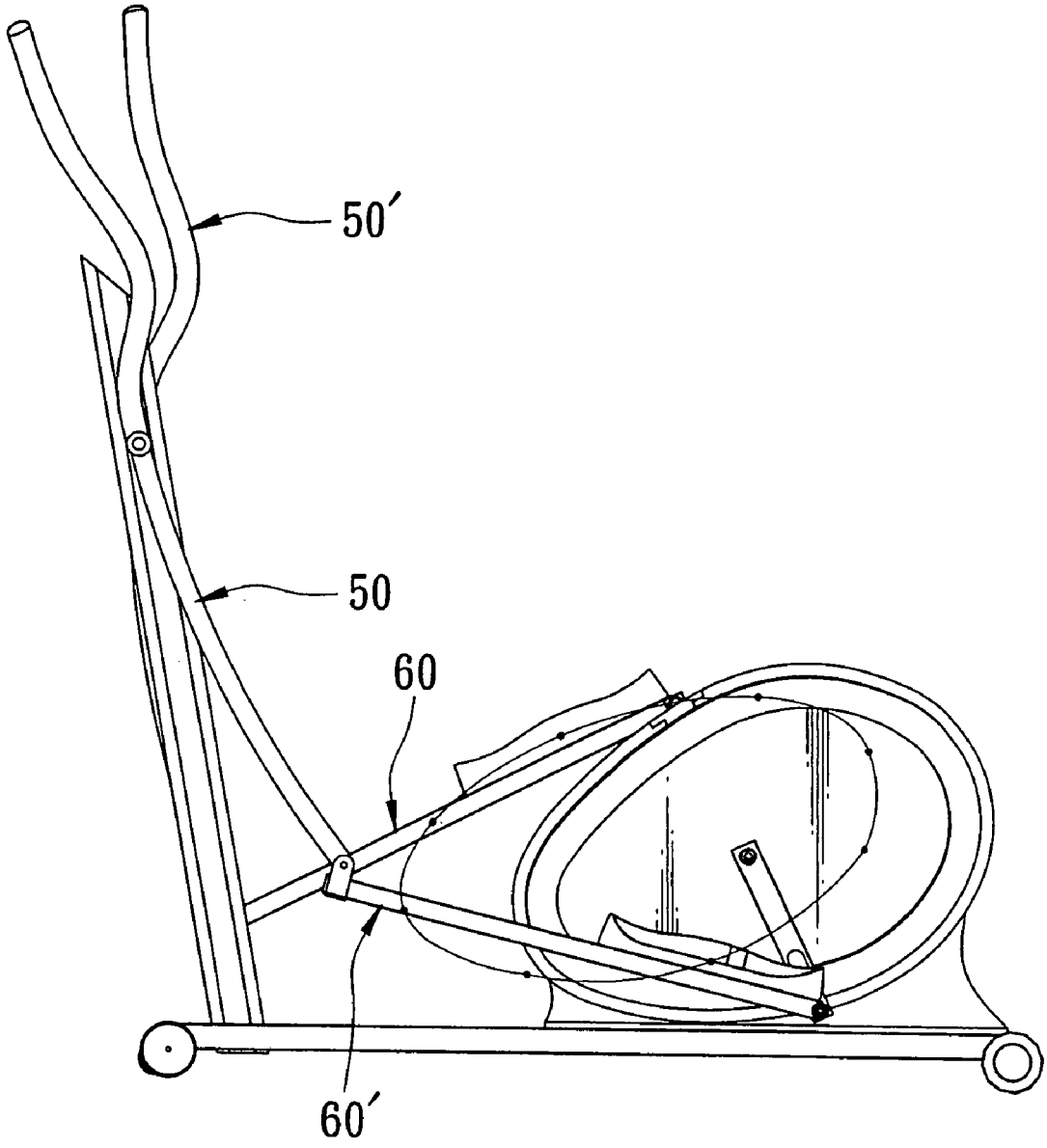
FIG. 7 is a schematic side view of the preferred embodiment, illustrating an elliptical motion of a left pedal.

Referring to FIG. 6, when the user steps on the pedals 63, 63' and holds and swings the handle sections 52, 52', the rollers 44, 44' move respectively along the guide slots 33, 33'. Movement of the rollers 44, 44' along the non-circular guide slots 33, 33' results in extension and retraction of the left and right extension links 40, 40' relative to the left and right cranks 20, 20'. Since the left and right foot links 60, 60' are connected respectively and pivotally to the left and right extension links 40, 40', the major and minor axes of an elliptical path (see FIG. 7) traveled by each of the pedals 63, 63' are long, thereby resulting in a good exercising effect.

Alternatively, the left and right connector members 50, 50' are not connected pivotally to the upright rod 13, and instead, are provided with rollers that are disposed respectively and rotatably on front ends thereof and that are disposed movably on the frame 10. This also allows the left and right connector members 50, 50' to reciprocate along the longitudinal direction of the frame 10.

With this invention thus explained, it is apparent that numerous modifications and variations can be made without departing from the scope and spirit of this invention. It is therefore intended that this invention be limited only as indicated by the appended claims.

I claim:

1. An elliptical exercise apparatus comprising:

an elongated frame having opposite first and second ends;

a pair of left and right cranks mounted rotatably on said frame and rotatable about a common crank axis;

a pair of left and right rails each disposed fixedly on said first end portion of said frame and having an inner rail surface disposed around said common crank axis, an outer rail surface disposed around said inner rail surface, and a non-circular guide slot defined between said inner and outer rail surfaces;

a pair of left and right extension links each having a first connecting portion, a second connecting portion, and a third connecting portion, said first connecting portions of said left and right extension links being connected respectively, radially, and slidably to said left and right cranks, said second connecting portion of each of said left and right extension links being mounted with a rotatable roller, said rollers being disposed respectively and movably within said guide slots;

a pair of left and right connector members disposed on said second end portion of said frame and reciprocatable along a longitudinal direction of said frame; and a pair of left and right foot links each having first and second ends connected respectively and pivotally to said third connecting portion of a corresponding one of said left and right extension links and a corresponding one of said left and right connector members.

2. The elliptical exercise apparatus as claimed in claim 1, wherein each of said left and right connector members has an upper pivot point disposed pivotally on said frame, a handle section located above said upper pivot point, and a lower pivot point opposite to said handle section and disposed below said upper pivot point, said lower pivot points of said left and right connector members being connected respectively and pivotally to said second ends of said left and right foot links.

3. The elliptical exercise apparatus as claimed in claim 1, wherein said frame includes a vertical mounting plate having left and right side surfaces formed respectively with said left and right rails, said left and right cranks being disposed respectively and rotatably on said left and right side surfaces of said mounting plate, said left and right rails being formed respectively in said left and right side surfaces of said mounting plate in proximity to a periphery of said mounting plate and being oval.

4. The elliptical exercise apparatus as claimed in claim 3, wherein said mounting plate includes a plate body having an annular outer surface defining said periphery of said mounting plate and formed with an adjacent pair of openings communicated respectively with said guide slots, and a seal plate connected removably to said plate body for sealing said openings, said openings being sized so as to allow said rollers to be passed respectively therethrough when said seal plate is removed from said plate body.

5. The elliptical exercise apparatus as claimed in claim 1, wherein said second connecting portion of each of said left and right extension links is located between said first and third connecting portions of a corresponding one of said left and right extension links.

6. The elliptical exercise apparatus as claimed in claim 1, wherein each of said left and right foot links includes a pedal fixed thereon and disposed in proximity to said first end of a corresponding one of said left and right foot links.

* * * * *